US012577688B2

(12) United States Patent
Weinelt et al.

(10) Patent No.: US 12,577,688 B2
(45) Date of Patent: Mar. 17, 2026

(54) ELECTROCHEMICAL OXIDATION OF FATTY ACIDS AND FATTY ACID ESTERS TO FORM MONOCARBOXYLIC ACIDS AND ALPHA-OMEGA-DICARBOXYLIC ACIDS

(71) Applicant: Evonik Operations GmbH, Essen (DE)

(72) Inventors: Frank Weinelt, Billerbeck (DE); Franz-Erich Baumann, Duelmen (DE); Siegfried R. Waldvogel, Gau-Algesheim (DE); Kamil Hofman, Frankfurt am Main (DE); Joachim Nikl, Frankfurt am Main (DE)

(73) Assignee: Evonik Operations GmbH, Essen (DE)

( * ) Notice: Subject to any disclaimer, the term of this patent is extended or adjusted under 35 U.S.C. 154(b) by 0 days.

(21) Appl. No.: 18/849,610

(22) PCT Filed: Mar. 22, 2023

(86) PCT No.: PCT/EP2023/057343
§ 371 (c)(1),
(2) Date: Sep. 23, 2024

(87) PCT Pub. No.: WO2023/186660
PCT Pub. Date: Oct. 5, 2023

(65) Prior Publication Data

US 2025/0223709 A1 Jul. 10, 2025

(30) Foreign Application Priority Data

Mar. 28, 2022 (EP) ..... 22164774

(51) Int. Cl.
*C25B 3/07* (2021.01)
*C25B 3/23* (2021.01)
*C25B 9/15* (2021.01)
*C25B 9/17* (2021.01)

(52) U.S. Cl.
CPC ..... *C25B 3/07* (2021.01); *C25B 3/23* (2021.01); *C25B 9/15* (2021.01); *C25B 9/17* (2021.01)

(58) Field of Classification Search
CPC ..... C25B 3/07; C25B 3/23
USPC ..... 205/440, 441
See application file for complete search history.

(56) References Cited

U.S. PATENT DOCUMENTS 2,450,858 A * 10/1948 Fitzpatrick ..... C11C 3/006 205/486
8,604,227 B2 12/2013 Petrat et al.
11,976,373 B2 5/2024 Weinelt et al.
2013/0006005 A1 1/2013 Petrat et al.
2019/0177478 A1 6/2019 Micoine et al.
2023/0212762 A1 7/2023 Weinelt et al.
2025/0109509 A1 4/2025 Weinelt et al.
2025/0215583 A1 7/2025 Baumann et al.
2025/0215584 A1 7/2025 Weinelt et al.

FOREIGN PATENT DOCUMENTS

CN 104032327 6/2016
EP 0 548 141 4/1992
JP 2019-99861 6/2019
WO 92/05299 4/1992
WO 2021/260679 12/2021
WO WO-2021260679 A1 * 12/2021 ..... C25B 11/067

OTHER PUBLICATIONS

Schafer, "Electrochemical Conversion of Fatty Acids," European Journal of Lipid Science and Technology (Jan. 2012), vol. 114, No. 1, pp. 2-9. (Year: 2012).*
Dörr et al., "Screening in der Elektrosynthese", Elektrosynthese, vol. 7, Aug. 2021, pp. 26-28.
European Search Report received for European Patent Application No. 22164774.6, mailed on Nov. 17, 2022, 8 pages.
Gütz et al., "Electrochemical Screening for Electroorganic Synthesis", Org. Process Res. Dev., vol. 20, Dec. 9, 2015, pp. 26-32.
International Search Report received for PCT Application No. PCT/EP2023/057343, mailed on Jul. 14, 2023, 7 pages, with English translation.
Kirste et al., "Anodic Phenol-Arene Cross-Coupling Reaction on Boron-Doped Diamond Electrodes", Angew. Chem. Int. Ed., vol. 49, 122, 2010, 10 pages, with English translation.
Written Opinion received for PCT Application No. PCT/EP2023/057343, mailed on Jul. 14, 2023, 11 pages with translation.
U.S. Appl. No. 16/216,143, filed Dec. 11, 2018, 2019/0177478, Micoine et al.
U.S. Appl. No. 18/850,115, filed Sep. 24, 2024, 2025/0215583, Baumann et al.
U.S. Appl. No. 18/851,145, filed Sep. 26, 2024, 2025/0215584, Weinelt et al.
U.S. Appl. No. 18/849,121, filed Sep. 20, 2024, 2025/0109509, Weinelt et al.

* cited by examiner

*Primary Examiner* — Edna Wong
(74) *Attorney, Agent, or Firm* — Grüneberg Global IP, PLLC

(57) ABSTRACT

A process produces aliphatic monocarboxylic acids and α,ω-dicarboxylic acids or α,ω-dicarboxylic monoesters by electrochemical oxidation of unsubstituted or at least monosubstituted, monounsaturated or polyunsaturated fatty acids or fatty acid esters in the presence of an inorganic or organic nitrate salt in an electrolysis cell in a reaction medium in the presence of oxygen.

46 Claims, No Drawings

ELECTROCHEMICAL OXIDATION OF FATTY ACIDS AND FATTY ACID ESTERS TO FORM MONOCARBOXYLIC ACIDS AND ALPHA-OMEGA-DICARBOXYLIC ACIDS

CROSS-REFERENCE TO RELATED APPLICATIONS

This application is a National Stage entry under § 371 of International Application No. PCT/EP2023/057343, filed on Mar. 22, 2023, and which claims the benefit of priority to European Patent Application No. 22164774.6, filed on Mar. 28, 2022. The content of each of these applications is hereby incorporated by reference in its entirety.

BACKGROUND OF THE INVENTION

Field of the Invention

The invention relates to a process for producing aliphatic monocarboxylic acids and α,ω-dicarboxylic acids or α,ω-dicarboxylic monoesters by electrochemical oxidation of unsubstituted or at least monosubstituted, monounsaturated or polyunsaturated fatty acids or fatty acid esters in the presence of an inorganic or organic nitrate salt in an electrolysis cell in a reaction medium in the presence of oxygen.

Monocarboxylic acids, α,ω-dicarboxylic acids and α,ω-dicarboxylic monoesters are important substrates for organic synthetic chemistry and monomer components for polymer syntheses and are therefore highly relevant to industrial applications. Conventional access to these substrates is mainly by the oxidative cleavage of a C═C double bond of fatty acids and fatty acid esters via processes based on the use of transition metals, additional oxidizing agents and/or on the principle of ozonolysis.

Description of Related Art

Known processes based on transition metals tend to pose toxic hazards to humans and the environment by their use. There is also the economic factor, since due to the increasing scarcity of raw materials, these methods are associated with ever higher costs. The purification of the products and recycling of the catalysts entails further operating complexity. The use of excess stoichiometric amounts required of oxidizing agents results in additionally waste reagents which must be disposed of. In most cases, the reaction necessarily proceeds at elevated or reduced temperatures, which may also have a negative effect on the energy balance of a process. The intermediates formed during ozonolysis are potentially explosive, which presents a considerable safety risk. In addition, ozone has to be formed as a reactive species by means of special generators, which entails increased equipment expenditure.

SUMMARY OF THE INVENTION

One object of the invention is to provide a sustainable and resource-saving process, which enables the production of monocarboxylic acids, α,ω-dicarboxylic acids and α,ω-dicarboxylic monoesters from fatty acids or fatty acid esters.

This object was achieved by the subject-matter of the embodiments and the description provided herein.

The present invention relates to a process for producing aliphatic monocarboxylic acids and α,ω-dicarboxylic acids or α,ω-dicarboxylic monoesters by electrochemical oxidation of unsubstituted or at least monosubstituted, monounsaturated or polyunsaturated fatty acids or fatty acid esters comprising the process steps of (a) providing at least one unsubstituted or at least monosubstituted, monounsaturated or polyunsaturated $C_6$-$C_{24}$ fatty acid or at least one unsubstituted or at least monosubstituted, monounsaturated or polyunsaturated $C_6$-$C_{24}$ fatty acid ester;

(b) providing at least one inorganic or organic nitrate salt;

(c) electrochemical oxidation of the unsubstituted or at least monosubstituted, monounsaturated or polyunsaturated fatty acid or of the unsubstituted or at least monosubstituted, monounsaturated or polyunsaturated fatty acid ester provided in step (a) in the presence of the inorganic or organic nitrate salt provided in step (b) in an electrolysis cell in a reaction medium in the presence of oxygen.

It was surprisingly found that, with the electrochemical oxidation process according to the invention, it is possible to use atmospheric oxygen to introduce the oxygen function into fatty acid or fatty acid ester. The fatty acids used as reactants can be obtained commercially by hydrolysis of the glycerol esters thereof, which are widely found in vegetable fats and oils, inter alia, and thus represent a renewable raw material. Methyl oleate is also obtained by transesterification of triglycerides with methanol and is used in biodiesel.

The process according to the invention for producing aliphatic α,-dicarboxylic acids and ow-dicarboxylic acid monoesters and also monocarboxylic acids of these renewable raw materials therefore offers a direct, sustainable and resource-saving alternative for the synthesis of important synthetic units, α,ω-Dicarboxylic acids serve primarily as monomers for large-scale industrial polyamide synthesis. α,ω-Dicarboxylic acid monoesters can enable industrial access to the corresponding dimers shortened by $C_2$ by means of Kolbe electrolysis. So far, synthetic access to these resultant long-chain dicarboxylic acid diesters has been poor. Therefore, both products are of great economic relevance.

This makes it possible to dispense with the use of chemical oxidants, such as reactive peroxides, and costly catalysts with complex ligand systems in the process according to the invention. At the same time, the use of toxic and/or potentially carcinogenic reagents can be reduced or even avoided altogether. The simple and safe process conditions allow scaling up to an industrial scale so that larger amounts of the desired products may also be produced. The present invention thus allows previously cost- and time-intensive processes to be substantially optimized in this way.

The process of the invention has the particular features of high selectivity, small amounts of auxiliary chemicals used, the use of electric current as oxidizing agent and, associated therewith, the generation of smaller amounts of waste products.

It was also surprisingly found that the process according to the invention makes it possible to use electric current to produce monocarboxylic acids, α,-dicarboxylic acids and α,ω-dicarboxylic acid monoesters with the use of nitrate salts, which act both as conducting salt and as electrochemical mediator.

It was additionally surprisingly found that the process according to the invention can be carried out at ambient pressure and ambient temperature, which is likewise advantageous for energy efficiency and thus for environmental compatibility too.

The $C_6$-$C_{24}$ fatty acids and $C_6$-$C_{24}$ fatty acid esters provided in step (a) according to the invention are monounsaturated or polyunsaturated, i.e. they have one or more C=C double bonds, for example 1, 2, 3 or 4 C=C double bonds. The fatty acids and fatty acid esters may be either in cis-configuration or in trans-configuration. If a fatty acid or a fatty acid ester has more than one C=C double bond, both configurations may be present in one molecule. The fatty acids and fatty acid esters may be linear or branched, with linear chains being preferred. The fatty acids and fatty acid esters may be unsubstituted or at least monosubstituted. Where they are mono- or polysubstituted, they are preferably substituted with 1, 2, 3, 4 or 5 substituents, each independently selected from the group consisting of methyl, phenyl or benzyl. The phenyl or benzyl substituents may themselves each be unsubstituted or mono- or polysubstituted with 1, 2 or 3 substituents, each independently selected from the group consisting of F, Cl, Br and $NO_2$.

DETAILED DESCRIPTION OF THE INVENTION

In a preferred embodiment of the process according to the invention, step (a) provides at least one unsubstituted, monounsaturated or polyunsaturated $C_6$-$C_{24}$ fatty acid or at least one unsubstituted, monounsaturated or polyunsaturated $C_6$-$C_{24}$ fatty acid ester.

In a further preferred embodiment of the process according to the invention, step (a) provides at least one unsubstituted, monounsaturated $C_6$-$C_{24}$ fatty acid or at least one unsubstituted, monounsaturated $C_6$-$C_{24}$ fatty acid ester, In a particularly preferred embodiment of the process according to the invention, step (a) provides at least one monounsaturated or polyunsaturated fatty acid selected from the group consisting of hex-3-enoic acid, undecylenic acid, myristoleic acid, palmitoleic acid, margaroleic acid, petroselinic acid, oleic acid, elaidic acid, vaccenic acid, gadoleic acid, gondoic acid, cetoleic acid, erucic acid, nervonic acid, linoleic acid, alpha-linolenic acid, gamma-linolenic acid, calendulic acid, punicic acid, alpha-eleostearic acid, beta-eleostearic acid, arachidonic acid, eicosapentaenoic acid, docosadienoic acid, docosatetraenoic acid, docosahexaenoic acid and tetracosahexaenoic acid, optionally in the form of an ester, especially selected from the group consisting of hex-3-enoic acid, myristoleic acid, palmitoleic acid, petroselinic acid, oleic acid, elaidic acid, vaccenic acid, gadoleic acid, gondoic acid, cetoleic acid, erucic acid, nervonic acid, linoleic acid, docosadienoic acid, linolenic acid, arachidonic acid, optionally in the form of an ester.

Especially preferably suitable as fatty acid or fatty acid ester according to step (a) of the process according to the invention is an oleic acid selected from the group consisting of oleic acid, elaidic acid, erucic acid and linoleic acid, optionally in the form of an ester.

If a fatty acid ester is provided in accordance with step (a) of the process according to the invention, preference is given to methyl esters or ethyl esters of the fatty acid.

According to step (b) of the process according to the invention, at least one inorganic or organic nitrate salt is provided. This nitrate salt functions both as the conducting salt and as the mediator of the electrochemical oxidation process according to the invention. Preference is given to using an inorganic or organic nitrate of the general formula $$[\text{cation}^+][NO_3^-]$$

where the [cation$^+$] is selected from the group consisting of $Na^+$, $K^+$, ammonium ions having the general structure $[R^1R^2R^3R^4N^+]$ where $R^1$, $R^2$, $R^3$, $R^4$ are each independently selected from the group consisting of $C_1$ to $C_{16}$ alkyl, especially $C_1$ to $C_8$ alkyl, straight-chain or branched, imidazolium cations having the general structure (I)

(I)

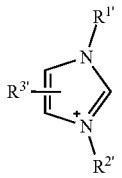

where $R^{1'}$ and $R^{2'}$ are each independently selected from the group consisting of $C_1$ to $C_{18}$ alkyl, straight-chain or branched, especially $C_1$ to $C_8$ alkyl, straight-chain or branched, and $R^{3'}$ is selected from the group consisting of H and $C_1$ to $C_{18}$ alkyl, straight-chain or branched, especially from the group consisting of H and $C_1$ to $C_8$ alkyl, straight-chain or branched, pyridinium cations having the general structure (II)

(II)

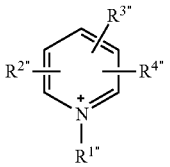

where $R^{1''}$ is selected from the group consisting of $C_1$ to $C_{18}$ alkyl, especially $C_1$ to $C_8$ alkyl, straight-chain or branched, and $R^{2''}$, $R^{3''}$, and $R^{4''}$ are each independently selected from the group consisting of H and $C_1$ to $C_{18}$ alkyl, straight-chain or branched, especially from the group consisting of H and $C_1$ to $C_8$ alkyl, straight-chain or branched, and phosphonium ions having the general structure $[R^{1a}R^{2a}R^{3a}R^{4a}P^+]$ where $R^{1a}$, $R^{2a}$, $R^{3a}$, $R^{4a}$ are each independently selected from the group consisting of $C_1$ to $C_{16}$ alkyl, especially $C_1$ to $C_8$ alkyl, straight-chain or branched.

Where an organic nitrate based on imidazolium cations is used in the process according to the invention, preference is given to cations of the general formula (I) in which $R^{1'}$ and $R^{2'}$ are each independently selected from the group consisting of $C_1$ to $C_{18}$ alkyl, straight-chain or branched, especially $C_1$ to $C_8$ alkyl, straight-chain or branched and $R^3$ is hydrogen. Particularly preferred are imidazolium cations of the general formula (I) in which $R^{1'}$ is methyl and $R^{2'}$ is ethyl or $R^{1'}$ is methyl and $R^{2'}$ is methyl and $R^{1'}$ is methyl and $R^{2'}$ is butyl, and $R^{3'}$ is in each case hydrogen.

Where a nitrate based on pyridinium cations is used in the process according to the invention, preference is given to cations of the general formula (II) in which $R^{1''}$ is $C_1$- to $C_{18}$-alkyl, straight-chain or branched, especially $C_1$- to $C_8$-alkyl, straight-chain or branched. Particularly preferred are pyridinium cations of the general formula (II) in which $R^{1''}$ is $C_1$- to $C_{18}$-alkyl, straight-chain or branched, especially $C_1$- to $C_8$-alkyl, straight-chain or branched, and the radicals $R^{2''}$, $R^{3''}$, and $R^{4''}$ are each independently selected from the group consisting of $C_1$- to $C_8$-alkyl, straight-chain or branched, preference being given to single substitution in the 2-, 3- or 4-position, double substitution in the 2,4-, 2,5- or 2,6-position or triple substitution in the 2,4,6-position.

It is in principle also possible to use two or more of the abovementioned nitrate salts in the process according to the invention. Preference is given to using a nitrate salt according to the invention, especially an organic ammonium nitrate salt of composition $[R^1R^2R^3R^4N^+][NO_3^-]$ or an organic phosphonium salt of composition $[R^{1a}R^{2a}R^{3a}R^{4a}P^+][NO_3^-]$, particular preference being given to an organic ammonium nitrate salt of composition $[R^1R^2R^3R^4N^+][NO_3^-]$.

Very particularly preferably, the organic ammonium nitrate salt is tetra-n-butylammonium nitrate or methyltri-n-octylammonium nitrate. The organic phosphonium nitrate salt is very particularly preferably tetra-n-butylphosphonium nitrate or methyltri-n-octylphosphonium nitrate. The organic imidazolium nitrate salt is preferably 1-butyl-3-methylimidazolium nitrate.

Most preferably, the organic nitrate salt used in the process according to the invention is tetra-n-butylammonium nitrate or methyltri-n-octylammonium nitrate.

The order in which the components used in the process according to the invention are provided may vary, as can the order in which the individual components are brought into contact with each other or with the respective reaction medium.

In one embodiment of the process according to the invention, the fatty acid or the fatty acid ester or the inorganic or organic nitrate salt is initially charged and brought together with the reaction medium, preferably at least partially or completely dissolved in the reaction medium or mixed therewith, and then the other of these two components in each case is added. In another embodiment of the process according to the invention, the fatty acid or the fatty acid ester and the inorganic or organic nitrate salt are initially charged and then brought together with the reaction medium, preferably at least partially or completely dissolved in the reaction medium or mixed therewith. Furthermore, it is also possible that in the process according to the invention the fatty acid or the fatty acid ester and the inorganic or organic nitrate salt are added to the reaction medium at the same time or one after the other, preferably at least partially or completely dissolved in the reaction medium or mixed therewith.

The reaction medium used in the process according to the invention is liquid under the conditions under which the process is carried out and is suitable for partially or completely dissolving the components used, i.e. especially the fatty acid used or the fatty acid ester and the inorganic or organic nitrate salt. Where at least one of these components is used in liquid form, the reaction medium is preferably readily miscible with said component(s).

In the process according to the invention, preference is given to using a polar aprotic reaction medium for the electrochemical oxidation. This may be used in anhydrous form, in dried form or else in combination with water.

Where an inorganic nitrate salt, especially potassium nitrate or sodium nitrate, is used in the process according to the invention, the reaction medium advantageously contains water, preference being given to aprotic reaction medium in combination with water. The water content in the reaction medium may vary. The water content is preferably up to 20% by volume, more preferably up to 15% by volume, especially preferably up to 10% by volume, even more preferably up to 5% by volume, in each case based on the total amount of reaction medium.

Preferably, the polar aprotic reaction medium is selected from the group consisting of aliphatic nitriles, aliphatic ketones, cycloaliphatic ketones, dialkyl carbonates, cyclic carbonates, lactones, aliphatic nitroalkanes, and dimethyl sulfoxide, esters and ethers, or a combination of at least two of these components.

Particularly preferably, the reaction medium is selected from the group consisting of acetonitrile, isobutyronitrile, adiponitrile, acetone, dimethyl carbonate, methyl ethyl ketone, 3-pentanone, cyclohexanone, nitromethane, nitropropane, tert-butyl methyl ether, dimethyl sulfoxide, gamma-butyrolactone and epsilon-caprolactone or a combination of at least two of these components.

Very particularly preferably, the reaction medium is selected from the group consisting of acetonitrile, isobutyronitrile, adiponitrile, dimethyl carbonate and acetone or a combination of at least two of these components.

Very particularly preferably, the reaction medium is acetonitrile, isobutyronitrile or adiponitrile in dried or anhydrous form.

Likewise very particularly preferably, the reaction medium is acetonitrile, isobutyronitrile or adiponitrile, optionally in combination with water.

Where one or more of the abovementioned components is used in the reaction medium in combination with water, the water content is preferably up to 20% by volume, more preferably up to 15% by volume, especially preferably up to 10% by volume, even more preferably up to 5% by volume, in each case based on the total amount of reaction medium.

For the performance of the process according to the invention it may be advantageous to add further solubilizing components to the reaction medium. Suitable advantageous components may be identified through simple preliminary tests of dissolution behaviour.

Examples of solubilizing components are primary alcohols, secondary alcohols, monoketones or dialkyl carbonates or mixtures of at least two of these components, optionally in combination with water. Preference can be given to using aliphatic $C_{1-6}$ alcohols in the process according to the invention; particularly preferred solubilizing components can be selected from the group consisting of methanol, ethanol, isopropanol, 2-methyl-2-butanol or mixtures of at least two of these components, optionally in combination with water.

It may be especially advantageous to use, as reaction medium, dimethyl carbonate, optionally in combination with at least one $C_{1-6}$ alcohol selected in particular from the group consisting of methanol, ethanol, isopropanol, 2-methyl-2-butanol, optionally in combination with water.

Where one or more of these solubilizing components is used in combination with water, the water content is preferably up to 20% by volume, more preferably up to 15% by volume, especially preferably up to 10% by volume, even more preferably up to 5% by volume, in each case based on the total amount of solubilizing component and water.

The solubilizing components may be added preferably in amounts of <50% by volume, more preferably of <30% by volume, especially preferably of <10% by volume, in each case based on the total amount of reaction medium.

Preferably, the inorganic or organic nitrate salt is used in the process according to the invention in an amount of 0.1 to 2.0, preferably 0.2 to 1.0, more preferably 0.3 to 0.8 and especially preferably 0.4 to 0.8, equivalents, in each case based on the amount of fatty acid or fatty acid ester.

In accordance with the invention, the electrochemical oxidation of the fatty acid or of the fatty acid ester is carried out in the presence of the inorganic or organic nitrate salt in an electrolysis cell in a reaction medium in the presence of oxygen, the electrochemical oxidation preferably being carried out in an electrolysis cell.

It is advantageous when an oxygen-containing gas atmosphere that is in spatial communication with the reaction medium is provided.

It is advantageous when an oxygen-containing gas atmosphere that is in spatial communication with the reaction medium is provided.

The proportion of oxygen in the gas atmosphere may vary. Preferably, the proportion of oxygen in the gas atmosphere is 10% to 100% by volume, more preferably 15% to 30% by volume, more preferably 15% to 25% by volume, especially preferably 18% to 22% by volume.

In one embodiment, the proportion of oxygen in the gas atmosphere may be 10% to 100% by volume, more preferably 15% to 100% by volume, more preferably 20% to 100% by volume.

Very particularly preferably, the gas atmosphere is air.

It is advantageous when a gas exchange is forced between the gas atmosphere and the reaction medium, preferably by introducing gas atmosphere into the reaction medium or by stirring the liquid phase in the presence of the gas atmosphere.

The gas exchange between the gas atmosphere and the reaction medium, especially the stirring, can be used to control the electrochemical oxidation, for example via the geometry of the stirrer or the stirrer speed.

Preferably, the amount of oxygen dissolved in the reaction medium is at least 1 mmol/L of reaction medium, more preferably at least 5 mmol/L of reaction medium.

Likewise preferably, the amount of oxygen dissolved in the reaction medium is at least 10 mmol/L of reaction medium.

The process according to the invention can be carried out both in a divided and in an undivided electrolysis cell, preference being given to an undivided electrolysis cell.

To avoid undesired chemical reactions, it is sometimes advantageous to separate cathode compartment and anode compartment and to allow the exchange of charge between anode compartment and cathode compartment to take place only through a porous diaphragm, commonly an ion-exchange resin.

The undivided electrolysis cell preferably used according to the invention has at least two electrodes. Anodes and cathodes made of customary materials may be used for this purpose, for example ones made of glassy carbon, boron-doped diamond (BDD) or graphite. The use of glassy carbon electrodes is preferred.

Preferably, the undivided electrolysis cell has at least one glassy carbon anode or at least one glassy carbon cathode. Preferably, both the anode and the cathode are glassy carbon electrodes.

The distance between the electrodes may vary over a certain range, Preferably, the distance is 0.1 mm to 2.0 cm, more preferably 0.1 mm to 1.0 cm, especially preferably 0.1 mm to 0.5 cm.

In addition, the process according to the invention may be carried out batchwise or continuously, preferably in an undivided flow-through electrolysis cell.

The process according to the invention is preferably carried out with an amount of charge of at least 190 C (2 F) to 970 C (10 F), preferably 290 C (3 F) to 870 C (9 F), particularly preferably 330 C (3.5 F) to 820 C (8.5 F), especially preferably 380 C (4 F) to 775 C (8 F), most preferably 380 C (4 F) to 580 C (6 F), in each case for 1 mmol of fatty acid or fatty acid ester used, in each case of one double bond in the fatty acid or the fatty acid ester used.

Preferably, the electrochemical oxidation in the process according to the invention is carried out at a constant current.

The current density at which the process according to the invention is carried out is preferably at least 5 mA/cm$^2$ or at least 10 mA/cm$^2$ or at least 15 mA/cm$^2$ or at least 20 mA/cm$^2$, or 20 mA/cm$^2$ to 50 mA/cm$^2$, where the stated surface area refers to the geometric area of the electrodes.

An important advantage of the process according to the invention is that electric current is used as oxidant, which represents a particularly environmentally friendly agent when it comes from renewable sources, i.e. in particular from biomass, solar thermal energy, geothermal energy, hydropower, wind power or photovoltaics.

The process according to the invention can be carried out over a wide temperature range, for example at a temperature in the range of 0 to 60° C., preferably 5 to 50° C., particularly preferably 10 to 40° C., especially preferably at 15 to 30° C.

The process according to the invention may be carried out at elevated or reduced pressure. Where the process according to the invention is carried out at elevated pressure, a pressure of up to 16 bar is preferred, particularly preferably up to 6 bar.

Likewise preferably, the process according to the invention may be carried out at atmospheric pressure.

The products produced by the process according to the invention may be isolated and purified by customary processes known to those skilled in the art, especially by extraction, crystallization, centrifugation, precipitation, distillation, evaporation or chromatography.

The following examples further elucidate the present invention but are not intended to limit the scope of the invention.

General Information and Methods

Chemicals of analytical quality were obtained from the usual suppliers (such as TCI, Aldrich and Acros) and used. The oxygen was obtained in 2.5 quality from Nippon Gases Deutschland GmbH, Düsseldorf, Germany and used as is.

The electrode material used was glassy carbon (Sigradur® G, from HTW Hochtemperatur Werkstoffe GmbH, Thierhaupten, Germany).

Gas chromatographic analyses were carried out on a Shimadzu GC-2010 (Shimadzu, Japan), which is equipped with a ZB-FFAP capillary GC column (Zebron, USA; length: 30 m, internal diameter: 0.25 mm, film thickness: 0.25 μm, carrier gas: argon).

NMR spectrometry of $^1$H-NMR and $^{13}$C-NMR spectra were recorded at 25° C. with a Bruker Avance II 400 (400 MHz, 5 mm BBFO probe with Z-gradient and ATM, SampleXPress 60 autosampler, Analytische Messtechnik, Karlsruhe, Germany).

Column chromatography was carried out with Kieselgel 60 M (0.040-0.063 mm, Macherey-Nagel GmbH & Co, Düren, Germany) and an eluent mixture of cyclohexane and ethyl acetate (9:1 to 7:3) with 1.0% by volume acetic acid as additive. Thin-layer chromatography was carried out on a Kieselgel 60 plate applied to aluminium (F254, Merck KGaA, Darmstadt, Germany). KMnO4 solution was used to stain the TLC plates (potassium permanganate reagent: 3 g KMnO4, 20 g K2CO3, 5 mL NaOH (5%), in 300 mL of water).

The undivided Teflon cells used for the electrolysis are described in the literature (a) C. Gütz, B. Klöckner, S. R. Waldvogel, Org. Process Res. Dev. 2016, 20, 26-32:b) A.

Kirste, G. Schnakenburg, F. Stecker, A. Fischer, S. R. Waldvogel, Angew. Chem. Int. Ed. 2010, 49, 971-975; Angew. Chem. 2010, 122, 983-967. (see SI).) The full range of these cells is commercially available as IKA Screening System (IKA-Werke GmbH & Co. KG, Staufen, Germany). The electrode dimensions were 7 cm×1 cm×0.3 cm.

Gases were introduced in a controlled manner via two model 5850S mass-flow controllers (MFCs) from Brooks Instrument B.V., Veenendaal, the Netherlands. This was done using one controller for the introduction of oxygen and one for the introduction of nitrogen. The controllers were controlled by means of Smart DDE and Matlab R2017b software. Volume flows were additionally monitored via a DK800 float-principle flowmeter from Krohne Messtechnik GmbH, Duisburg, For all experiments carried out, the overall volume flow was a constant 20 mL/min, which, limited by the MFCs used, also represents the maximum achievable volume flow. The percent volume flows of the two gases were adjusted using the MFCs and associated software. Gas cylinders from the following suppliers were used: Oxygen 2.5 from Nippon Gases Deutschland GmbH, Düsseldorf, and nitrogen 5.0 from Nippon Gases Deutschland GmbH, Düsseldorf. The gas distributor and the gas inlet covers of the electrolysis cells are described in the literature (M. Dörr, D. Waldmann, S. R. Waldvogel, GIT Labor-Fachz. 2021, 7-8, 26-28) and were purchased from IKA (IKA-Werke GmbH & Co. KG, Staufen. Germany).

General Procedure GP1

The fatty acid or the fatty acid ester (0.5 mmol) and tetrabutylammonium nitrate (0.2-1.0 eq.) were initially charged in an undivided 5 mL Teflon cup cell and dissolved in the solvent (5 mL). The cell is equipped with glassy carbon electrodes which were 0.5 cm apart. The immersed surface area of the electrodes is 1.8 $cm^2$. An oxygen atmosphere in the gas space of the electrolysis cell is adjusted (20-100% by volume). After the cell was fixed in a stainless steel block, a galvanostatic electrolysis is carried out at a current density of 5-20 $mA/cm^2$ at 5-50° C. The stirring speed is 100-500 rpm. After applying an amount of charge of 8-20 F (386-965 C based on 0.5 mmol of substrate) and completion of the reaction, 50.5 μL of propionic acid are added as internal standard and the yields determined by gas chromatography or in the case of azelaic acid 3b by isolating using column chromatography (eluent: cyclohexane/ethyl acetate=9:1 to 7:3, with 1.0% by volume acetic acid as additive).

According to GP1, the following fatty acids and fatty acid esters 1a-1c were converted to the corresponding carboxylic acids:

Scheme 1.

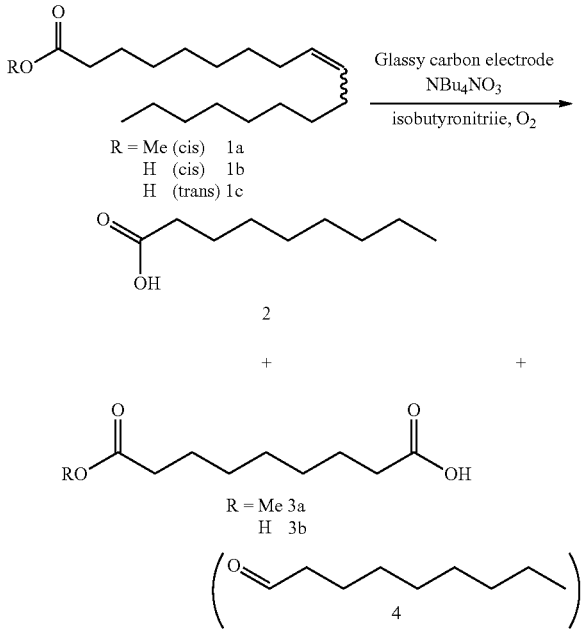

The process according to the invention was carried out varying different reaction parameters. Examples 1-17 are summarized with the respective conditions in Table 1.

TABLE 1

| Example No. | Methyl oleate 1a Tech. (ca. 70%) | Pelargonic acid 2[b] | Monomethyl azelate 3a[b] | Nonanal 4[b] |
|---|---|---|---|---|
| 1 | Standard condition[a] | 33% | 37% | 15% |
| 2 | MeCN as solvent | 18% | 19% | 15% |
| 3 | Amount of charge 8 F | 31% | 33% | 13% |
| 4 | Amount of charge 12 F | 23% | 27% | 9% |
| 5 | Current density 5 $mA/cm^2$ | 21% | 23% | 12% |
| 6 | Current density 20 $mA/cm^2$ | 10% | 16% | — |
| 7 | Temperature = 50° C. | 22% | 27% | — |
| 8 | Temperature = 5° C. | 30% | 35% | 15% |
| 9 | Conducting salt 0.02M (0.2 eq.) | 24% | 26% | 14% |
| 10 | Conducting salt 0.1M (1.0 eq.) | 30% | 35% | 11% |
| 11 | Stirring speed 500 rpm | 31% | 33% | 14% |
| 12 | Stirring speed 100 rpm | 14% | 23% | — |
| 13 | $O_2/N_2$ = 20/80 | 8% | 13% | — |
| 14 | $O_2/N_2$ = 0/100 | — | — | — |
| | Methyl oleate 1a Pure (99.0%) | Pelargonic acid 2[b] | Monomethyl azelate 3a[b] | Nonanal 4[b] |
| 15 | Standard condition | 46% | 46% | 21% |

TABLE 1-continued

| | Oleic acid 1b | Pelargonic acid 2[b] | Azelaic acid 3b[c] | Nonanal 4[b] |
|---|---|---|---|---|
| 16 | Standard condition | 27% | 35% | 15% |
| | Elaidic acid 1c | Pelargonic acid 2[b] | Azelaic acid 3b[c] | Nonanal 4[b] |
| 17 | Standard condition | 23% | 32% | 14% |

[a]Standard condition: Reactant = 0.5 mmol, $NBu_4NO_3$ = 0.05M (0.5 eq.), isobutyronitrile = 5.0 mL, electrodes = GC||GC, $O_2/N_2$ = 100/0 (20 mL/min), amount of charge = 10 F, current density = 10 mA/cm$^2$, stirring speed = 350 rpm, T = 23° C.
[b]yields determined via GC with propionic acid as internal standard (ISTD)
[c]isolated yields.

Example No. 15

According to GP1, methyl oleate 1a (pure, 99%, 0.149 g, 0.5 mmol, 1.0 eq.) was electrolyzed galvanostatically under an oxygen atmosphere (100% by volume) and application of 10 F. The yield of the products was determined by gas chromatography with propionic acid as ISTD: pelargonic acid 2 (0.23 mmol), monomethyl azelate 3a (0.23 mmol), nonanal 4 (0.11 mmol).

Example No. 16

According to GP1, oleic acid 1b (0.141 g, 0.5 mmol, 1.0 eq.) was electrolyzed galvanostatically under an oxygen atmosphere (100% by volume) and application of 10 F. The yield of the products was determined by gas chromatography with propionic acid as ISTD: pelargonic acid 2 (0.14 mmol), nonanal 4 (0.08 mmol).

Azelaic acid 3b was isolated by column chromatography: 44 mg, 0.18 mmol and the structure confirmed by $^1$H-NMR spectroscopy: $^1$H-NMR (300 MHz, DMSO-d6) δ[ppm]=11.97 (s, 2H); 2.18 (t, J=7.3 Hz, 4H); 1.50-1.43 (m, 4H); 1.26-1.24 (m, 6H). These analytical data are in agreement with the literature values.

Example No. 17

According to GP1, elaidic acid 1c (0.141 g, 0.5 mmol, 1.0 eq.) was electrolyzed galvanostatically under an oxygen atmosphere (100% by volume) and application of 10 F. The yield of the product was determined by gas chromatography with propionic acid as ISTD: pelargonic acid 2 (0.12 mmol), nonanal 4 (0.07 mmol).

Azelaic acid 3b was isolated by column chromatography: 40 mg, 0.16 mmol and the structure confirmed by $^1$H-NMR spectroscopy:

$^1$H-NMR (300 MHz, DMSO-d6) δ[ppm]=11.97 (s, 2H); 2.18 (t, J=7.3 Hz, 4H); 1.50-1.43 (in, 4H); 1.26-1.24 (m, 6H). The analytical data are in agreement with the literature values.

Example No. 18

According to GPI, polyunsaturated fatty acids can also be oxidized, as shown in the example linoleic acid 5 (see Scheme 2, Table 2).

Scheme 2.

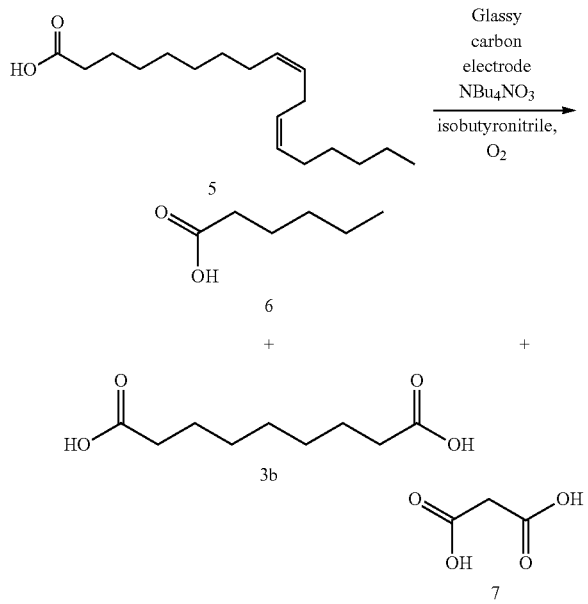

TABLE 2

| Example No. | Linoleic acid 5 Tech. (ca. 60-70%) | Caproic acid 6[b] | Malonic acid 7[b] |
|---|---|---|---|
| 18a | Standard condition[a] | 20% | 28% |
| 18b | Conducting salt 0.1M (1.0 eq.) | 21% | 25% |

[a]Standard condition: Reactant = 0.5 mmol, $NBu_4NO_3$ = 0.05M (0.5 eq.), isobutyronitrile = 5.0 mL, electrodes = GC||GC, $O_2/N_2$ = 100/0 (20 mL/min), amount of charge = 10 F, current density = 10 mA/cm$^2$, stirring speed = 350 rpm, T = 23° C.
[b]yields determined via GC with propionic acid as internal standard (ISTD).

Azelaic acid 3b was verified qualitatively via HPLC-MS.

The invention claimed is:

1. A process for producing aliphatic monocarboxylic acids and α,ω-dicarboxylic acids or α,ω-dicarboxylic monoesters by electrochemical oxidation of at least one unsubstituted or at least one monosubstituted, monounsaturated or polyunsaturated fatty acid or fatty acid ester, the process comprising:

(a) providing at least one unsubstituted or at least one monosubstituted, monounsaturated or polyunsaturated $C_6$-$C_{24}$ fatty acid, or at least one unsubstituted or at least one monosubstituted, monounsaturated or polyunsaturated $C_6$-$C_{24}$ fatty acid ester, wherein substituents of the $C_6$-$C_{24}$ fatty acid are selected from the group consisting of methyl, phenyl and benzyl substituents, wherein the phenyl and benzyl substituents are themselves each unsubstituted or mono-or polysubstituted with 1, 2 or 3 substituents, each independently selected from the group consisting of: F, Cl, Br, and $NO_2$;

(b) providing at least one inorganic or organic nitrate salt, wherein the nitrate salt of (b) is present as a nitrate of formula [cation$^+$][$NO_3^-$], where [cation$^+$] is selected from the group consisting of: $Na^+$, $K^+$, an ammonium ion having a structure [$R^1R^2R^3R^4N^+$] where $R^1$, $R^2$, $R^3$, and $R^4$ are each independently selected from the group consisting of: $C_1$- to $C_{16}$-alkyl, an imidazolium cation of formula (I)

(I)

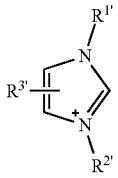

where radicals $R^{1'}$ and $R^{2'}$ are selected from: $C_1$- to $C_{18}$-alkyl, and $R^{3'}$ is selected from the group consisting of: H and $C_1$- to $C_{18}$-alkyl, a pyridinium cation of formula (II)

(II)

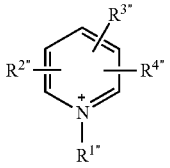

where $R^{1''}$ is selected from: $C_1$- to $C_{18}$-alkyl, and $R^{2''}$, $R^{3''}$, and $R^{4''}$ are selected from: H and $C_1$- to $C_{18}$-alkyl, and a phosphonium ion of structure [$R^{1a}R^{2a}R^{3a}R^{4a}p^+$] where $R^{1a}$, $R^{2a}$, $R^{3a}$, and $R^{4a}$ are selected from: $C_1$- to $C_{16}$-alkyl;

(c) electrochemical oxidation of the at least one unsubstituted or the at least one monosubstituted, monounsaturated or polyunsaturated fatty acid or of the at least one unsubstituted or the at least monosubstituted, monounsaturated or polyunsaturated fatty acid ester provided in (a) in the presence of the at least one inorganic or organic nitrate salt provided in (b) in an electrolysis cell in a reaction medium in the presence of oxygen.

2. The process according to claim 1, wherein (a) provides the at least one unsubstituted, monounsaturated or polyunsaturated $C_6$-$C_{24}$ fatty acid or the at least one unsubstituted, monounsaturated or polyunsaturated $C_6$-$C_{24}$ fatty acid ester.

3. The process according to claim 2, wherein provided in (a) is the at least one unsubstituted monounsaturated or polyunsaturated $C_6$-$C_{24}$ fatty acid selected from the group consisting of: hex-3-enoic acid, undecylenic acid, myristoleic acid, palmitoleic acid, margaroleic acid, petroselinic acid, oleic acid, elaidic acid, vaccenic acid, gadoleic acid, gondoic acid, cetoleic acid, erucic acid, nervonic acid, linoleic acid, alpha-linolenic acid, gamma-linolenic acid, calendulic acid, punicic acid, alpha-eleostearic acid, beta-eleostearic acid, arachidonic acid, eicosapentaenoic acid, docosadienoic acid, docosatetraenoic acid, docosahexaenoic acid and tetracosahexaenoic acid, optionally in the form of an ester when (a) is provided with the at least one unsubstituted, monounsaturated or polyunsaturated $C_6$-$C_{24}$ fatty acid ester.

4. The process according to claim 2, wherein provided in (a) the at least one unsubstituted monounsaturated or polyunsaturated $C_6$-$C_{24}$ fatty acid is at least one selected from the group consisting of oleic acid, erucic acid, linoleic acid and elaidic acid, optionally in the form of an ester when (a) is provided with the at least one unsubstituted, monounsaturated or polyunsaturated $C_6$-$C_{24}$ fatty acid ester.

5. The process according to claim 1, wherein the at least one unsubstituted or the at least one monosubstituted, monounsaturated or polyunsaturated $C_6$-$C_{24}$ fatty acid ester is a methyl ester or an ethyl ester.

6. The process according to claim 1, wherein, in the imidazolium cation of formula (I), the radicals $R^{1'}$ and $R^{2'}$ are selected from: $C_1$ to $C_{18}$ alkyl, and $R^{3'}$ is hydrogen.

7. The process according to claim 1, wherein, in the pyridinium cation of formula (II), the radical $R^{1''}$ is $C_1$ to $C_{18}$ alkyl, and the radicals $R^{2''}$, $R^{3''}$, and $R^{4''}$ are selected from $C_1$ to $C_8$ alkyl.

8. The process according to claim 1, wherein the at least one organic nitrate salt is provided, and wherein the at least one organic nitrate salt is selected from the group consisting of: tetra-n-butylammonium nitrate, methyltri-n-octylammonium nitrate, tetra-n-butylphosphonium nitrate, methyltri-n-octylphosphonium nitrate, and 1-butyl-3-methylimidazolium nitrate.

9. The process according to claim 1, wherein the at least one unsubstituted or the at least one monosubstituted, monounsaturated or polyunsaturated $C_6$-$C_{24}$ fatty acid, or the at least one unsubstituted or the at least one monosubstituted, monounsaturated or polyunsaturated $C_6$-$C_{24}$ fatty acid ester, or the at least one inorganic or organic nitrate salt, is initially charged and brought together with the reaction medium, and then the other of these two components in each case is added.

10. The process according to claim 1, wherein the at least one unsubstituted or the at least one monosubstituted, monounsaturated or polyunsaturated $C_6$-$C_{24}$ fatty acid, or the at least one unsubstituted or the at least one monosubstituted, monounsaturated or polyunsaturated $C_6$-$C_{24}$ fatty acid ester, and the at least one inorganic or organic nitrate salt, are initially charged and then brought together with the reaction medium.

11. The process according to claim 1, wherein the at least one unsubstituted or the at least one monosubstituted, monounsaturated or polyunsaturated $C_6$-$C_{24}$ fatty acid, or the at least one unsubstituted or the at least one monosubstituted, monounsaturated or polyunsaturated $C_6$-$C_{24}$ fatty acid ester, and the at least one inorganic or organic nitrate salt, are added to the reaction medium at the same time or one after the other.

12. The process according to claim 1, wherein the reaction medium is a polar aprotic reaction medium, optionally in combination with water, wherein the polar aprotic reaction medium is selected from the group consisting of: aliphatic nitriles, aliphatic ketones, cycloaliphatic ketones, dialkyl carbonates, cyclic carbonates, lactones, aliphatic nitroalkanes, dimethyl sulfoxide, esters, ethers, and mixtures of at least two of these components.

13. The process according to claim 12, wherein a water content is up to 20% by volume, based on a total amount of the reaction medium.

14. The process according to claim 12, wherein the polar aprotic reaction medium is selected from the group consisting of: acetonitrile, isobutyronitrile, adiponitrile, acetone, dimethyl carbonate, methyl ethyl ketone, 3-pentanone, cyclohexanone, nitromethane, nitropropane, tert-butyl methyl ether, dimethyl sulfoxide, gamma-butyrolactone, epsilon-caprolactone, and mixtures of at least two of these components, in each case optionally in combination with the water.

15. The process according to claim 12, wherein the reaction medium is acetonitrile, isobutyronitrile or adiponitrile in dried or anhydrous form.

16. The process according to claim 1, wherein the reaction medium comprises one or more solubilizing components.

17. The process according to claim 16, wherein primary alcohols, secondary alcohols, monoketones or dialkyl carbonates or mixtures of at least two of these components, optionally in combination with water, are present as the one or more solubilizing components.

18. The process according to claim 16, wherein aliphatic $C_{1-6}$ alcohols are present as the one or more solubilizing components, optionally in combination with water.

19. The process according to claim 16, wherein the one or more solubilizing components are added in an amount of <50% by volume, present based on a total amount of the reaction medium.

20. The process according to claim 1, wherein dimethyl carbonate is present as the reaction medium, optionally in combination with at least one $C_{1-6}$ alcohol.

21. The process according to claim 1, wherein the reaction medium comprises water.

22. The process according to claim 1, wherein the at least one inorganic or organic nitrate salt is present in an amount from 0.1 to 2.0, equivalents, based on an amount of the at least one unsubstituted or the at least one monosubstituted, monounsaturated or polyunsaturated $C_6$-$C_{24}$ fatty acid, or the at least one unsubstituted or the at least one monosubstituted, monounsaturated or polyunsaturated $C_6$-$C_{24}$ fatty acid ester used.

23. The process according to claim 1, wherein a gas atmosphere comprising the oxygen is provided spatially connected to the reaction medium.

24. The process according to claim 23, wherein the gas atmosphere is air.

25. The process according to claim 24, wherein gas exchange is forced between the gas atmosphere and the reaction medium by introducing the gas atmosphere into the reaction medium, or by stirring the reaction medium in the presence of the gas atmosphere.

26. The process according to claim 25, wherein the stirring is used to control the electrochemical oxidation.

27. The process according to claim 1, wherein an amount of the oxygen dissolved in the reaction medium is at least 1 mmol/L of the reaction medium.

28. The process according to claim 1, wherein the electrolysis cell is an undivided electrolysis cell.

29. The process according to claim 28, wherein the undivided electrolysis cell comprises a glassy carbon anode, a graphite anode or a boron-doped diamond (BDD) anode.

30. The process according to claim 28, wherein the undivided electrolysis cell comprises a glassy carbon cathode, a graphite cathode or a boron-doped diamond (BDD) cathode.

31. The process according to claim 1, wherein a distance between electrodes in the electrolysis cell is 0.1 mm to 2.0 cm.

32. The process according to claim 1, wherein an amount of charge is at least 190 C (2 F) to 970 C (10 F), for 1 mmol of the at least one unsubstituted or the at least one monosubstituted, monounsaturated or polyunsaturated $C_6$-$C_{24}$ fatty acid, or the at least one unsubstituted or the at least one monosubstituted, monounsaturated or polyunsaturated $C_6$-$C_{24}$ fatty acid ester used, for one double bond in the at least one unsubstituted or the at least one monosubstituted, monounsaturated or polyunsaturated $C_6$-$C_{24}$ fatty acid, or the at least one unsubstituted or the at least one monosubstituted, monounsaturated or polyunsaturated $C_6$-$C_{24}$ fatty acid ester used.

33. The process according to claim 1, wherein the electrochemical oxidation is carried out at a constant current.

34. The process according to claim 1, wherein a current density is at least 5 mA/cm$^2$, where a stated surface area refers to a geometric area of electrodes.

35. The process according to claim 1, wherein a current density is at least 20 mA/cm$^2$ to 50 mA/cm$^2$, where a stated surface area refers to a geometric area of electrodes.

36. The process according to claim 1, wherein a current used for the electrochemical oxidation comes from a renewable source.

37. The process according to claim 1, wherein the electrochemical oxidation takes place at a temperature in a range of from 0 to 60° C.

38. The process according to claim 1, wherein the electrochemical oxidation is carried out under atmospheric pressure.

39. The process according to claim 1, wherein the electrochemical oxidation is carried out under reduced pressure.

40. The process according to claim 1, wherein the electrochemical oxidation is carried out under elevated pressure.

41. The process according to claim 1, wherein the electrochemical oxidation in the electrolysis cell is carried out in an undivided cell.

42. The process according to claim 1, wherein the electrochemical oxidation is carried out batchwise.

43. The process according to claim 1, wherein the electrochemical oxidation in the electrolysis cell is carried out continuously in an undivided flow-through electrolysis cell.

44. The process according to claim 1, wherein the electrochemical oxidation is carried out continuously.

45. The process according to claim 1, wherein the electrochemical oxidation is carried out without an addition of a catalyst.

46. The process according to claim 1, wherein no further oxidants besides the oxygen or oxygen in air are added.

* * * * *